US009581027B2

(12) United States Patent
Romanowski et al.

(10) Patent No.: US 9,581,027 B2
(45) Date of Patent: Feb. 28, 2017

(54) AIRFOIL FOR GAS TURBINE, BLADE AND VANE

(71) Applicant: ALSTOM Technology Ltd, Baden (CH)

(72) Inventors: Marcin Romanowski, Nussbaumen (CH); Marcel Koenig, Wettingen (CH); Laura Bogdanic, Wettingen (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 456 days.

(21) Appl. No.: 14/280,927

(22) Filed: May 19, 2014

(65) Prior Publication Data

US 2014/0363302 A1 Dec. 11, 2014

(30) Foreign Application Priority Data

Jun. 5, 2013 (EP) ..... 13170564

(51) Int. Cl.
*F01D 5/14* (2006.01)

(52) U.S. Cl.
CPC ..... *F01D 5/14* (2013.01); *F01D 5/143* (2013.01); *F01D 5/145* (2013.01)

(58) Field of Classification Search
CPC ..... F01D 5/14; F01D 5/145; F01D 5/143
USPC ..... 416/223 R, 239, 241 R, 248
See application file for complete search history.

(56) References Cited

U.S. PATENT DOCUMENTS

| | | | | |
|---|---|---|---|---|
| 4,431,376 | A * | 2/1984 | Lubenstein | F01D 5/141 416/223 A |
| 5,480,285 | A * | 1/1996 | Patel | F01D 5/141 416/223 A |
| 6,190,128 | B1 | 2/2001 | Fukuno et al. | |
| 8,287,241 | B2 * | 10/2012 | Strohl | F01D 5/141 416/190 |
| 2010/0284815 | A1 | 11/2010 | Parker et al. | |
| 2012/0049010 | A1 * | 3/2012 | Speer | B64C 23/065 244/45 R |
| 2013/0336767 | A1 * | 12/2013 | Levine | F01D 5/187 415/115 |

FOREIGN PATENT DOCUMENTS

| | | |
|---|---|---|
| CN | 101117895 A | 2/2008 |
| EP | 1 731 712 | 12/2006 |
| EP | 2 184 442 | 5/2010 |
| GB | 2 353 826 | 3/2001 |
| SU | 556238 | 4/1977 |
| WO | 2005/116404 | 12/2005 |

* cited by examiner

*Primary Examiner* — Hoang Nguyen
(74) *Attorney, Agent, or Firm* — Buchanan Ingersoll & Rooney PC

(57) ABSTRACT

The invention relates to an airfoil for a gas turbine, which comprises a compound fillet disposed between the airfoil and a platform. The compound fillet consists of a first arc and a second arc. A first end of the first arc tangentially adjoins an outer surface of the airfoil. A second end of the first arc tangentially adjoins a first end of the second arc. A second end of the second arc tangentially adjoins a surface of the platform, wherein the following equation is satisfied: $0.15 \leq R1/s \leq 0.45$, and $0.09 \leq a/s \leq 0.27$.

4 Claims, 3 Drawing Sheets

AIRFOIL FOR GAS TURBINE, BLADE AND VANE

CROSS-REFERENCE TO RELATED APPLICATIONS

This application claims priority to European application 13170564.2 filed Jun. 5, 2013, the contents of which are hereby incorporated in its entirety.

TECHNICAL FIELD

The present invention relates to an airfoil for a gas turbine, in particular, to a compound fillet between an airfoil and a platform. The present invention also relates to a blade and a vane for a gas turbine.

BACKGROUND

A gas turbine typically includes at least one rotor assembly in which a plurality of blades/vanes, comprising airfoils radially extending from platforms, are circumferentially fitted and distributed around a rotor disk. During operation, centrifugal forces generate circumferential rim stress in the rotating blades. As for vanes, gas pressure and vibration may also generate stress. These stresses can concentrate at the transition between the platform and the airfoil. This stress concentration can be minimized by fillets at the platform/airfoil connection portion. Adequate stress relief can however only be achieved with an adequately sized and shaped fillet.

Generally, it is desirable to reduce the size of the platform, or alternatively avoid reworking of a blade/vane when it is discovered in final design stages that there is insufficient space between the airfoil and platform edge to enable tangentially joining the fillet to the platform surface. It is therefore desirable to provide a compound fillet consisting of multiple sections of curves that requires less platform surface space without compromising mechanical integrity.

A compound fillet for a turbine blade is disclosed in EP2184442A1, which covers an airfoil to platform join and is configured to comprise a first arc and a second arc. The first arc has a first end tangential to the airfoil surface. The second arc having a first end tangentially adjoins the second end of the first arc and a second end adjoins the plat form surface. The radius of the first arc is larger than the radius of the second arc. Furthermore, another compound fillet also is disclosed in this reference, which comprises a first arc and a second arc wherein the second arc adjoins non-tangentially the platform surface.

A kind of transition between a surface of a blade/vane airfoil and a platform at an end of the airfoil is disclosed in GB2353826A, which comprises at least two curves of different radii, the radius of the curve nearest the surface of the airfoil being larger than the radius of the curve nearest to the platform. The transition may comprise two curves of different radii separated by a straight line section, or it may form a section of an ellipse.

A cooled moving blade for a gas turbine is disclosed in U.S. Pat. No. 6,190,128 B1, which has a base portion of a profile formed by an elliptically curved surface and a rectilinear surface portion, wherein the rectilinear surface portion is provided at a hub portion of the blade where thermal stress is large.

Even though different compound fillets are proposed in the above mentioned publications, there exists much more space to develop in respect of optimizing the parameters of compound fillet in order to improve the stress relief capacity of the blade/vane, hence improve the working life of the blade or vane.

SUMMARY

It is an object of the present invention is to provide an airfoil for a blade and/or a vane, which could optimize the structure for stress relief, in order to prolong the working lives thereof.

In one aspect of the present invention, an airfoil for a gas turbine is proposed, which comprises a compound fillet disposed between the airfoil and a platform, wherein the compound fillet consists of a first arc and a second arc, a first end of the first arc tangentially adjoining an outer surface of the airfoil, a second end of the first arc tangentially adjoining a first end of the second arc, and a second end of the second arc tangentially adjoining a surface of the platform, wherein the following equation is satisfied:

$$0.15 \leq R1/s \leq 0.45, \text{ and}$$

$$0.09 \leq a/s \leq 0.27,$$

where R1 represents the radius of the first arc, s represent the chord length of the airfoil, and a represents the distance between the point where the first end of the first arc adjoins the outer surface of the airfoil and the top surface of the platform in the direction along the extension of the outer surface of the airfoil.

According to one possible embodiment of the present invention, the following equation is further satisfied:

$$0.024 \leq R2/s \leq 0.072,$$

where R2 represents the radius of the second arc.

In another aspect of the present invention, a blade for a gas turbine is proposed, which comprises the airfoil according to the present invention.

In another aspect of the present invention, a vane for a gas turbine is proposed, which comprises the airfoil according to the present invention. With the present invention, the structure of the airfoil, the blade comprising the same and/or the vane comprising the same, are improved in stress relief capacity, and prevented from pre-mature cracks during operation of the blade and/or vane.

BRIEF DESCRIPTION OF THE DRAWINGS

The objects, advantages and other features of the present invention will become more apparent upon reading of the following non-restrictive description of preferred embodiments thereof, given for the purpose of exemplification only, with reference to the accompany drawing, in which.

DETAILED DESCRIPTION

Figure 1:
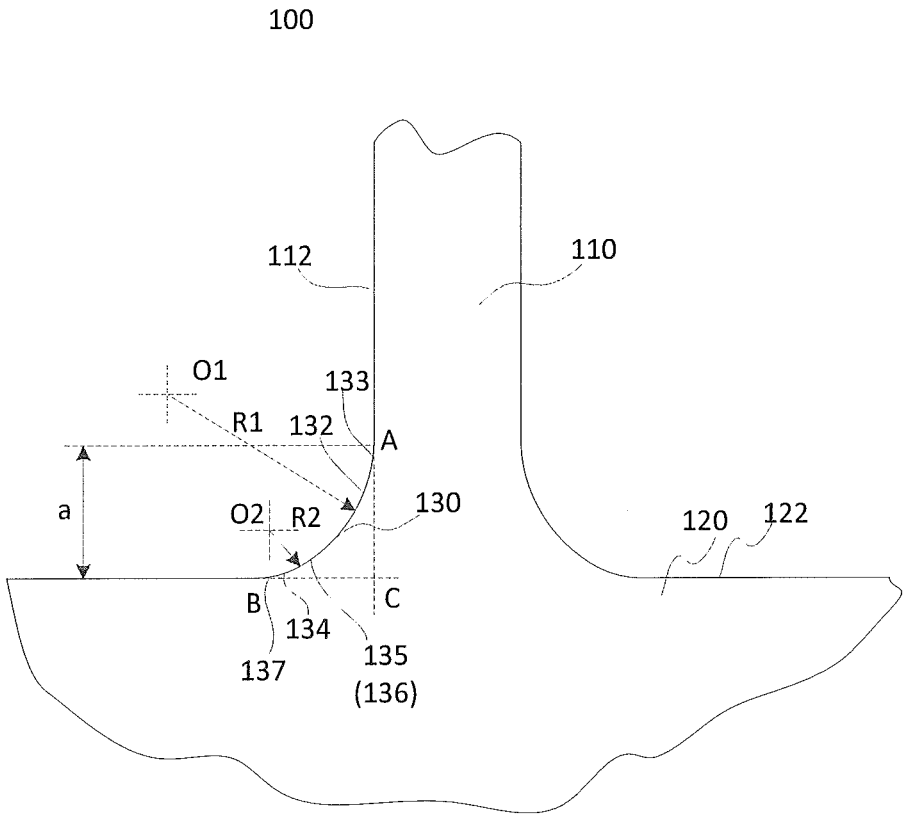
FIG. 1 shows a schematic cross section view of an airfoil for a blade of a gas turbine according to an example embodiment of the present invention.

FIG. 1 shows a schematic cut-away view of an airfoil 110 for a blade 100 of a gas turbine according to example embodiments of the present invention. The blade 100 comprises the airfoil 110 with an outer surface 112, and a platform 120 with a top surface 122. A compound fillet 130 is disposed between the airfoil 110 and the platform 120. Generally, the profile of the blade 100 represents a symmetrical structure. Thus, as shown in FIG. 1, one side of the airfoil 110 is numerated and described for purpose of simplicity and clarity. The compound fillet 130 comprises a first arc 132 with a radius R1 and a center O1, and a second arc 134 with a radius R2 and a center O2, where the first arc 132 tangentially adjoins at its first end 133 the outer surface 112 of the airfoil 110 at the point A, and the second arc 134 tangentially adjoins at its second end 137 the top surface 122 of the platform 120 at the point B, and the second end 135 of the first arc 132 and the first end 136 of the second arc 134 tangentially adjoin with each other. As shown in FIG. 1, it is defined that a length a indicates the distance between the point A and the platform 120 in the direction of the extension of the outer surface 112 of the airfoil, i.e. a represents the distance between the point A where the first end 133 of the first arc 132 adjoins the outer surface 112 of the airfoil 110 and the top surface 122 of the platform 120 in the direction along the extension of the outer surface 112 of the airfoil 110. As shown in FIG. 1, it is shown the extension of the outer surface 112 of the airfoil 110, represented by broken line, and the extension of the top surface 122 of the platform 120, represented also by broken line, intersect at point C. In this case, the length a represents the length AC.

Figure 2:
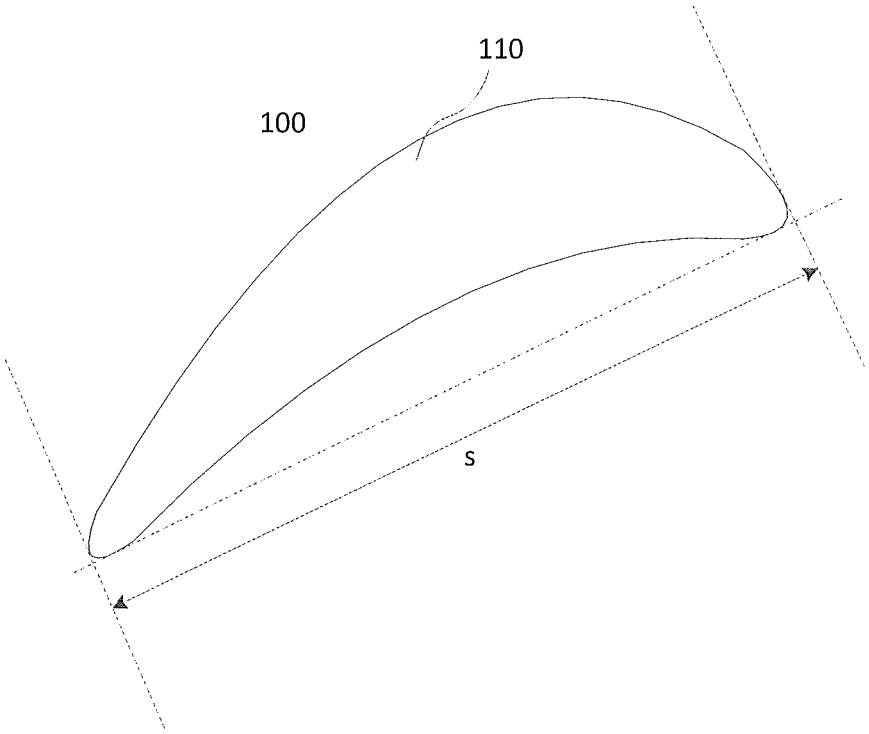
FIG. 2 shows a schematic cross-section view of the airfoil for the blade of the gas turbine according to an example embodiment of the present invention.

FIG. 2 shows the section view of the airfoil 110 of the blade 100 or vane 200 (shown in FIG. 3), where s represents a chord of the blade 100 or vane 200. Those skilled in the art should understand the term of "chord" as the common meaning as that mentioned in the art. That is, the chord of a blade/vane refers to the length of the perpendicular projection of the blade/vane profile onto the chord line, where the chord line refers to, if a two dimensional blade/vane section were laid convex side up on a flat surface, the line between the points where the front and rear of the blade/vane section would touch the surface.

According to one possible embodiment, the airfoil 110 is structured to satisfy the following equation:

$$0.15 \le R1/s \le 0.45, \text{ and} \quad (1)$$

$$0.09 \le a/s \le 0.27. \quad (2)$$

According to another possible embodiment, other than the equation (1) and (2), the airfoil is further structured to satisfy the following equation:

$$0.024 \le R2/s \le 0.072. \quad (3)$$

The airfoil 110 that satisfy the equations (1), (2) and (3) according to embodiments of the present invention, may provide a blade that optimizes stress relief capacity as the blade is operated with high speed under high temperature and pressure. Thus, the working life of the blade is substantially prolonged.

Figure 3:
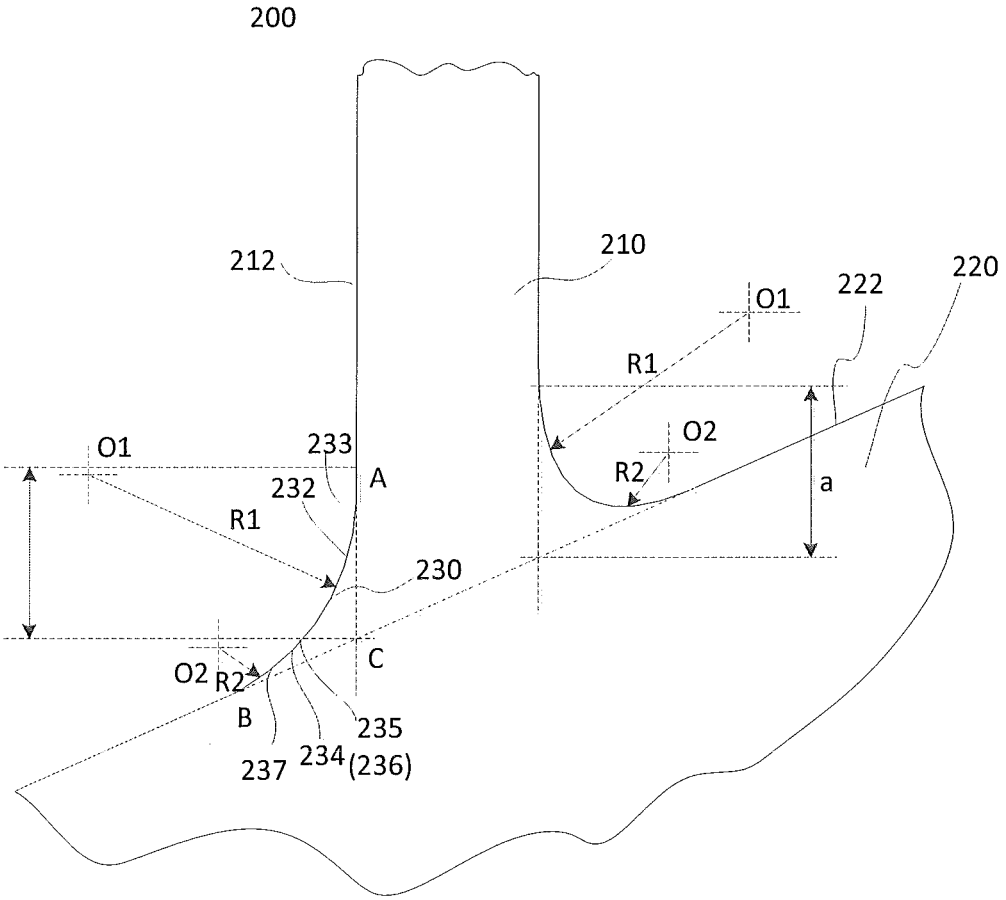
FIG. 3 shows a schematic cross section view of an airfoil for a vane of a gas turbine according to an example embodiment of the present invention.

FIG. 3 shows a schematic cut-away view of an airfoil 210 for a vane 200 of a gas turbine according to example embodiments of the present invention. The vane 200 comprises an airfoil 210 with an outer surface 212, and a platform 220 with a top surface 222. A compound fillet 230 is disposed between the airfoil 210 and the platform 220. The compound fillet 230 comprises a first arc 232 with a radius R1 and a center O1, and a second arc 234 with a radius R2 and a center O2, where the first arc 232 tangentially adjoins at its first end 233 the outer surface 212 of the airfoil 210 at the point A, and the second arc 234 tangentially adjoins at its second end 237 the top surface 222 of the platform 220 at the point B, and the second end 235 of the first arc 232 and the first end 236 of the second arc 234 tangentially adjoin with each other. As shown in FIG. 3, it is defined that a length a indicates the distance between the point A and the platform 220 in the direction of the extension of the outer surface 212 of the airfoil, i.e. a represents the distance between the point A where the first end 233 of the first arc 232 adjoins the outer surface 212 of the airfoil 210 and the top surface 222 of the platform 220 in the direction along the extension of the outer surface 212 of the airfoil 210. As shown in FIG. 3, it is shown the extension of the outer surface 212 of the airfoil, represented by broken line, and the extension of the top surface 222 of the platform 220, represented also by broken line, intersect at point C. In this case, the length a represents the length AC.

As shown in FIG. 3, and as is known by those skilled in the art, the axis of the vane 200 is generally angled with respect the platform by certain angles. Thus, the compound fillets 230 on the left and right side of the airfoil 210 differ in shape from each other. According to embodiments of the present invention, it is designed that R1, R2, a and s are adopted on both sides, except that the positions of O1 and O2 are different.

As described herein, the present invention may extensively apply to both blades and vanes of a gas turbine. Those skills in the art should understand that, the general concept of the present invention intends to cover both blade and vane utilized in a gas turbine. The objective is to optimize the structure of the blade and/or the vane, in order to prolong their working life and preventing pre-mature cracking due to stress generated by high speed rotation, high temperature and/or high pressure.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An airfoil for a gas turbine comprising a compound fillet disposed between the airfoil and a platform, wherein the compound fillet consists of a first arc and a second arc, a first end of the first arc tangentially adjoining an outer surface of the airfoil, a second end of the first arc tangentially adjoining a first end of the second arc, and a second end of the second arc tangentially adjoining a top surface of the platform, wherein the following equation is satisfied:

$$0.15 \le R1/s \le 0.45, \text{ and}$$

$$0.09 \le a/s \le 0.27,$$

where R1 represents the radius of the first arc, s represent the chord length of the airfoil, and a represents the distance between the point where the first end of the first arc adjoins the outer surface of the airfoil and the top surface of the platform in the direction along the extension of the outer surface of the airfoil.

2. The airfoil according to claim 1, wherein the following equation is further satisfied:

$$0.024 \le R2/s \le 0.072,$$

where R2 represents the radius of the second arc.

3. A blade for a gas turbine, comprising an airfoil according to claim 1.

4. A vane for a gas turbine, comprising an airfoil according to claim 1.

* * * * *